US006775932B2

(12) United States Patent
Lin

(10) Patent No.: US 6,775,932 B2
(45) Date of Patent: Aug. 17, 2004

(54) AIR BLADDER DEVICE HAVING PATTERN CHANGING MECHANISM

(76) Inventor: Li Chieh Lin, P.O. Box 63-298, Taichung (TW), 406

( * ) Notice: Subject to any disclaimer, the term of this patent is extended or adjusted under 35 U.S.C. 154(b) by 132 days.

(21) Appl. No.: 10/238,467

(22) Filed: Sep. 6, 2002

(65) Prior Publication Data

US 2004/0045192 A1 Mar. 11, 2004

(51) Int. Cl.[7] ..... A43B 23/00; A43B 13/20

(52) U.S. Cl. ..... 36/136; 36/29; 206/522; 446/320

(58) Field of Search ..... 36/136, 29, 132, 36/1; 446/180, 183, 199, 220, 391, 337, 339, 267, 221, 147, 340, 341, 320, 186, 188, 197; 383/3, 106; 206/522, 457; 40/212, 736

(56) References Cited

U.S. PATENT DOCUMENTS 1,605,985 A 11/1926 Rasmussen
1,649,770 A * 11/1927 Miller ..... 446/220
3,800,132 A * 3/1974 Postal ..... 362/34
4,576,585 A * 3/1986 Balogh et al. ..... 446/199
4,817,304 A 4/1989 Parker et al. ..... 36/114
4,845,865 A 7/1989 Chang et al. ..... 36/136
4,873,774 A * 10/1989 Lafever ..... 36/61
4,929,211 A * 5/1990 Resnick et al. ..... 446/14
4,966,568 A * 10/1990 Nakamura et al. ..... 446/221
5,363,570 A * 11/1994 Allen et al. ..... 36/28
5,397,000 A * 3/1995 Holte et al. ..... 206/545
5,447,010 A * 9/1995 Voigt ..... 53/427
5,577,723 A * 11/1996 DiResta et al. ..... 473/571
5,588,227 A 12/1996 Goldston et al. ..... 36/93
5,839,211 A * 11/1998 Pallera ..... 36/136
6,112,437 A * 9/2000 Lovitt ..... 36/137
6,164,729 A * 12/2000 Dibenedetto et al. .... 301/5.304

* cited by examiner

*Primary Examiner*—M. D. Patterson

(57) ABSTRACT

An air bladder device includes a casing having a transparent or semi-transparent wall, an air bag received in the casing, and one or more patterns disposed between the wall and the air bag. The air bag is inflatable to move the patterns toward and away from the wall. The patterns are preferably spatial patterns and are deformable, and may be deformed when the patterns are forced against the wall, such that the patterns may be seen through the wall as changing patterns. The casing may include a scale for indicating the inflation of the air bag by the deformed patterns.

12 Claims, 14 Drawing Sheets

AIR BLADDER DEVICE HAVING PATTERN CHANGING MECHANISM

BACKGROUND OF THE INVENTION

1. Field of the Invention

The present invention relates to an air bladder device, and more particularly to an air bladder device having a pattern changeable mechanism.

2. Description of the Prior Art

Various kinds of typical air bladder devices have been provided and disposed in the shoe sole for air cushioning purposes. One example of the air bladder devices is disclosed in U.S. Pat. No. 1,605,985 to Rasmusen, and two bags engaged in the shoe sole and communicating with each other. The bags may not be seen by the users.

U.S. Pat. No. 4,817,304 to Parker et al., discloses another typical air bladder device including an insert having a number of air tubes engaged in the shoe sole and communicating with each other. The side portions of the insert ma be seen through the gaps formed in the side portions of the shoe sole. However, no changing pattern may be formed or provided by Parker et al.

U.S. Pat. No. 4,845,865 to Chang et al. discloses a further typical air bladder device including an air pump for selectively pumping or inflating an ornament. The ornament may be inflated, but may not be compressed into various or changing patterns.

U.S. Pat. No. 5,588,227 to Goldston et al. discloses a still further typical air bladder device including a complicated pressure indicating means having a bellows type inflatable member for sensing and indicating the pressure in the bladder. However, the bellows members are also received in the shoe sole and may not been seen by the users, and may not be compressed to form changing patterns.

The present invention has arisen to mitigate and/or obviate the afore-described disadvantages of the conventional air bladder devices.

SUMMARY OF THE INVENTION

The primary objective of the present invention is to provide an air bladder device including a pattern changeable mechanism.

The other objective of the present invention is to provide an air bladder device including a mechanism for showing the inflation condition of the air bladder.

In accordance with one aspect of the invention, there is provided an air bladder device comprising a casing including a wall, and a chamber formed and defined in the wall, an air bag received in the chamber of the casing, and one or more patterns disposed between the wall of the casing and the air bag. The air bag is inflatable to move the patterns toward and away from the wall, for allowing the patterns to be seen through the wall as a changing pattern. It is preferable that the patterns are spatial patterns and are deformable, for allowing the spatial patterns to be deformed when the air bag is inflated and when the spatial patterns are forced and moved toward and against the wall. The deformed spatial patterns may thus be seen through the wall as changing patterns.

The air bag includes a nozzle for filling air into and out of the air bag. The casing includes an orifice formed therein for receiving the nozzle of the air bag.

The casing includes a scale provided on the wall, the patterns may include a stud shape structure and may be aligned with the scale and movable toward and away from the scale, and are deformable to indicate inflation of the air bag together with the scale.

A strap may further be provided and disposed between the wall of the casing and the air bag, and the patterns may be attached and supported on the strap.

The casing includes a panel having a groove formed therein, the strap includes a bottom peripheral portion received in the groove of the panel of the casing, for allowing the strap to be stably or solidly secured to the casing.

The casing may be received in an object, such as received in a cavity of a shoe sole, for allowing the casing to be depressed by users.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
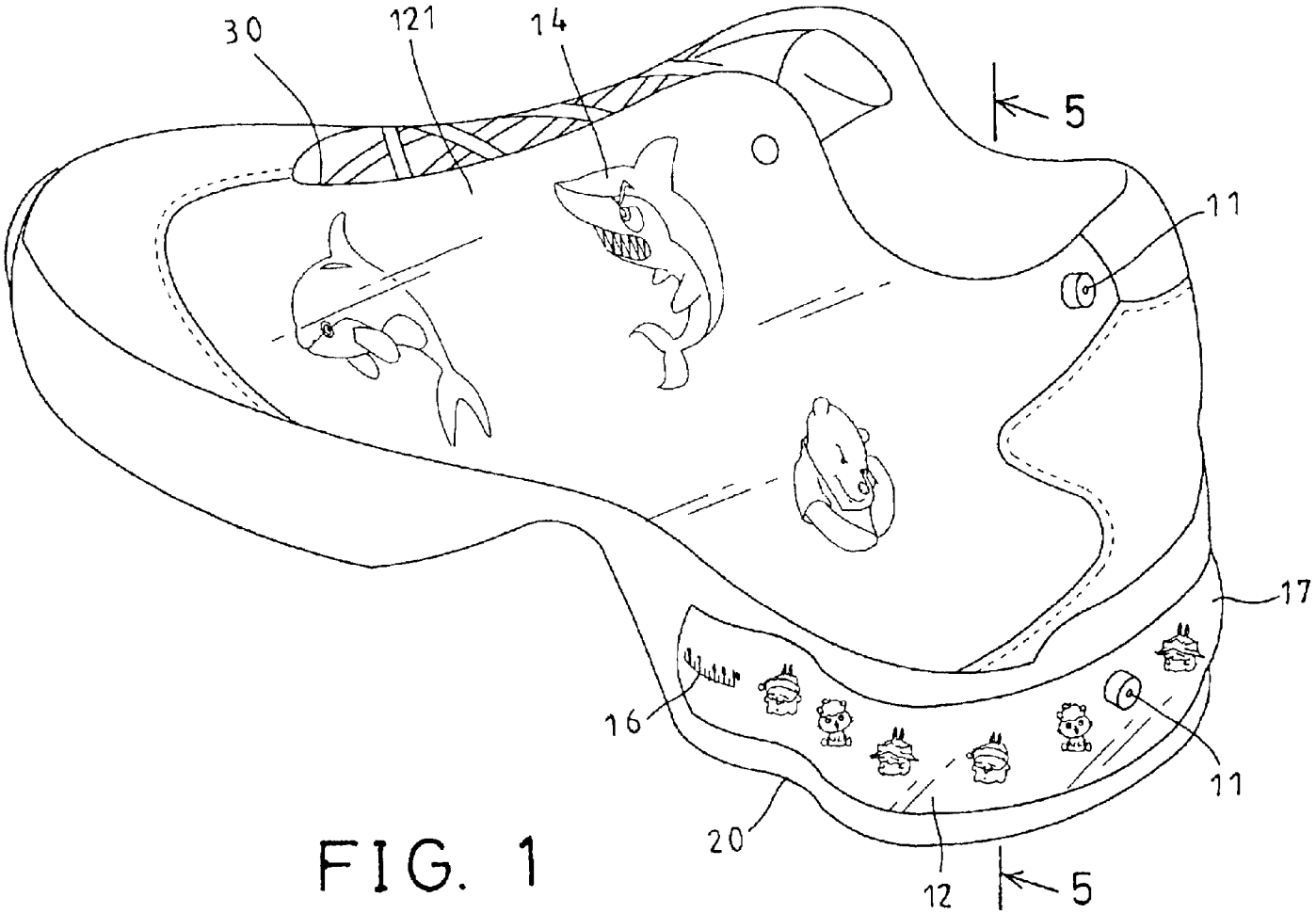
FIG. 1 is a perspective view of a shoe having an air bladder device in accordance with the present invention.
Figures 2, 3, 4:
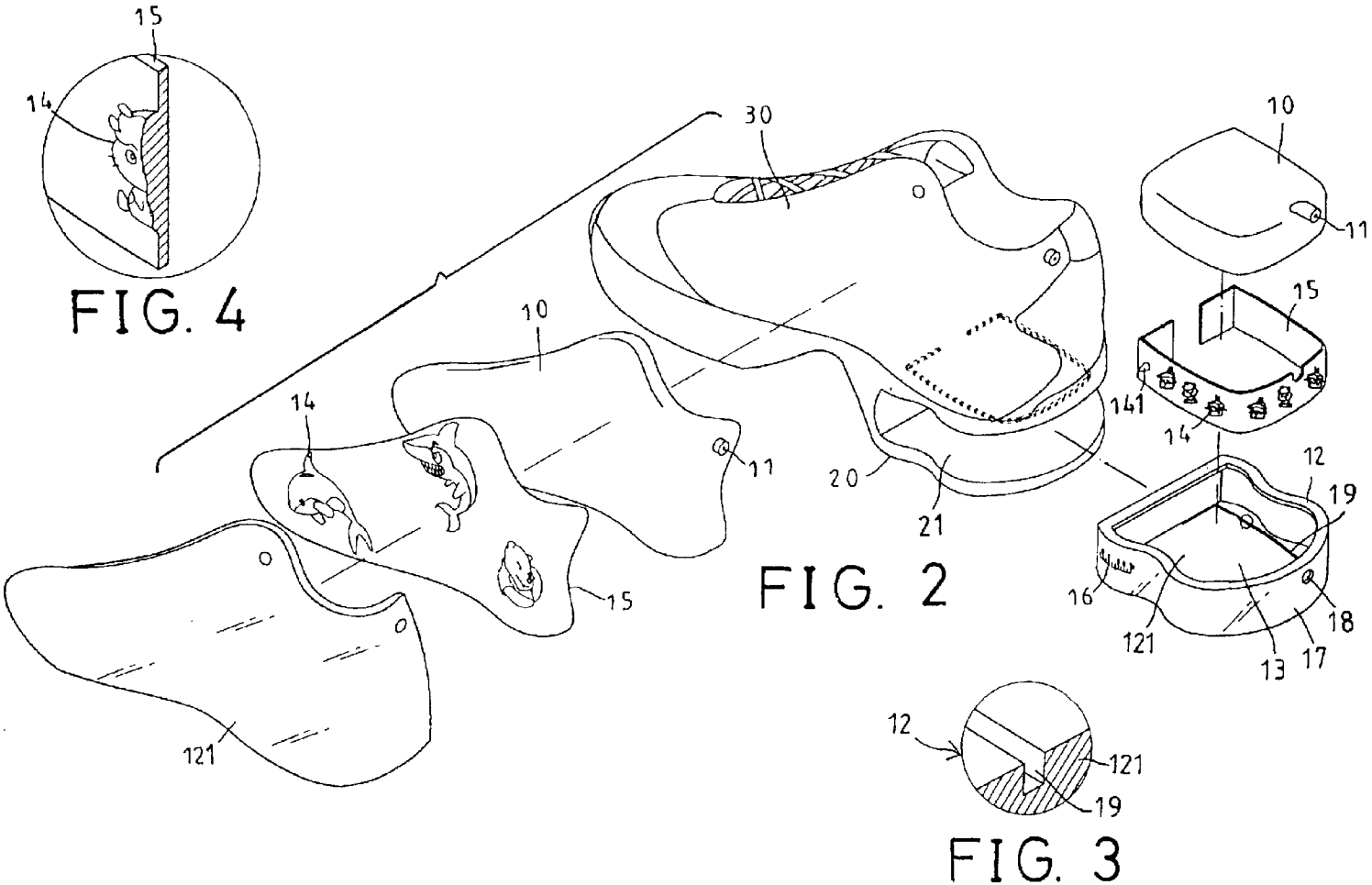
FIG. 2 is a partial exploded view of the air bladder device.
FIG. 3 is an enlarged partial perspective and partial cross sectional view showing a casing of the air bladder device.
FIG. 4 is an enlarged partial perspective and partial cross sectional view showing a film or a strap of the air bladder device.
Figure 5:
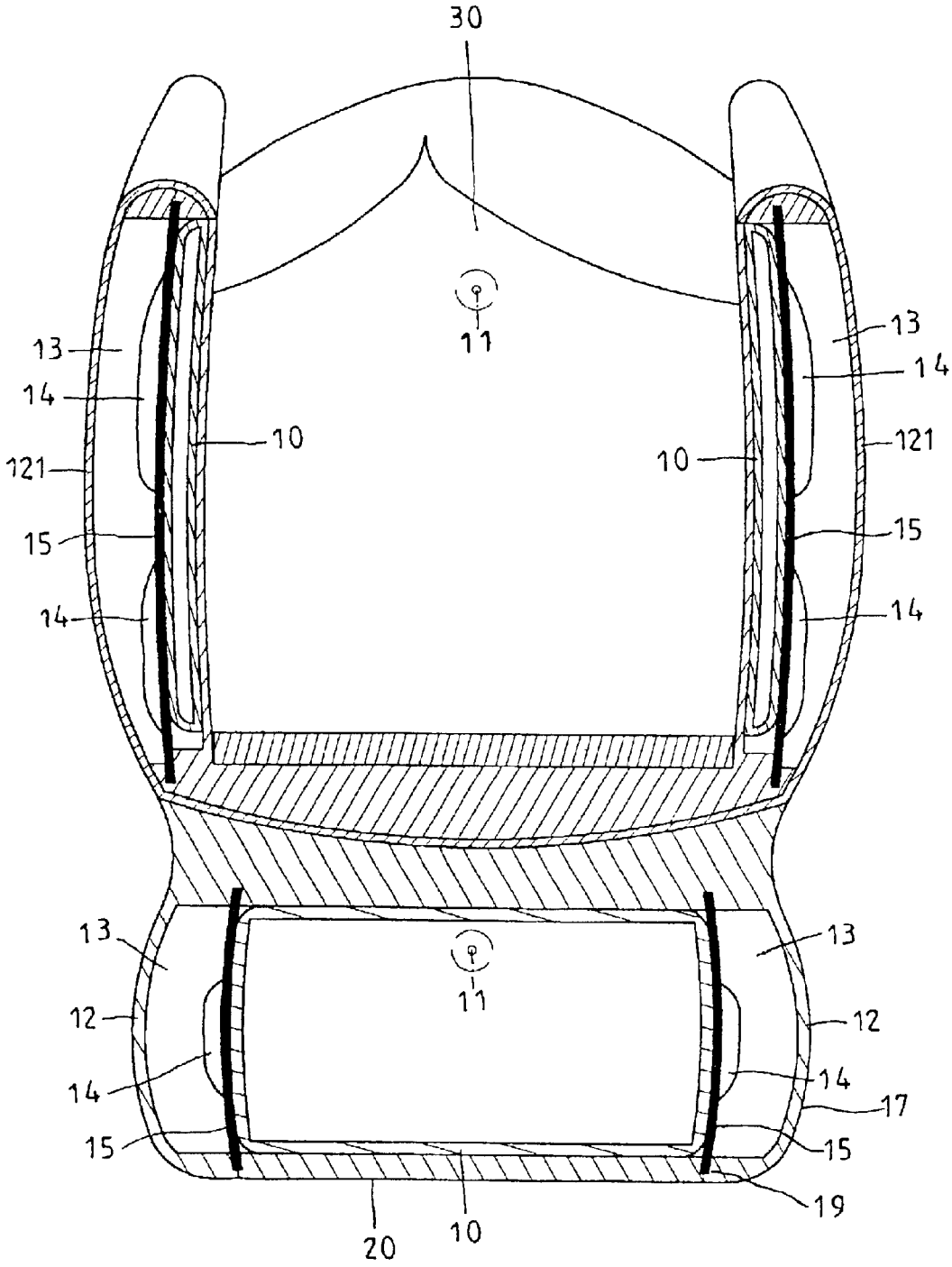
FIG. 5 is a cross sectional view taken along lines 5—5 of FIG. 1.

Referring to the drawings, and initially to FIGS. 1–5, an air bladder device in accordance with the present invention comprises an air bladder or air bag 10 received in a chamber 13 of a casing 12. The casing 12 includes a transparent or semi-transparent wall 17, such as an outer peripheral wall 17, and/or a bottom panel 121, for forming or defining the chamber 13 within the casing 12.

The casing 12 includes an orifice 18 formed in such as the wall 17 thereof for receiving a nozzle 11 of the air bag 10, and for filling air into or out of the air bag 10; and includes a peripheral groove 19 formed in the bottom panel 121 thereof (FIG. 3); and may include a scale 16 provided on the outer peripheral wall 17 thereof.

A film or a strap 15 may further or selectively provided and disposed in the chamber 13 of the casing 12, and includes a bottom peripheral portion 151 received in the peripheral groove 19 of the casing 12, for being positioned within the chamber 13 of the casing 12, and for preventing the strap 15 from easily moving relative to the casing 12.

The bottom peripheral portion of the strap 15 may simply be disposed or received within the peripheral groove 19 of the casing 12, or may be secured to the casing 12 with a force-fitted engagement, an adhesive material, one or more fasteners, or by welding processes, for stably positioning the strap 15 within the chamber 13 of the casing 12.

Figure 6:
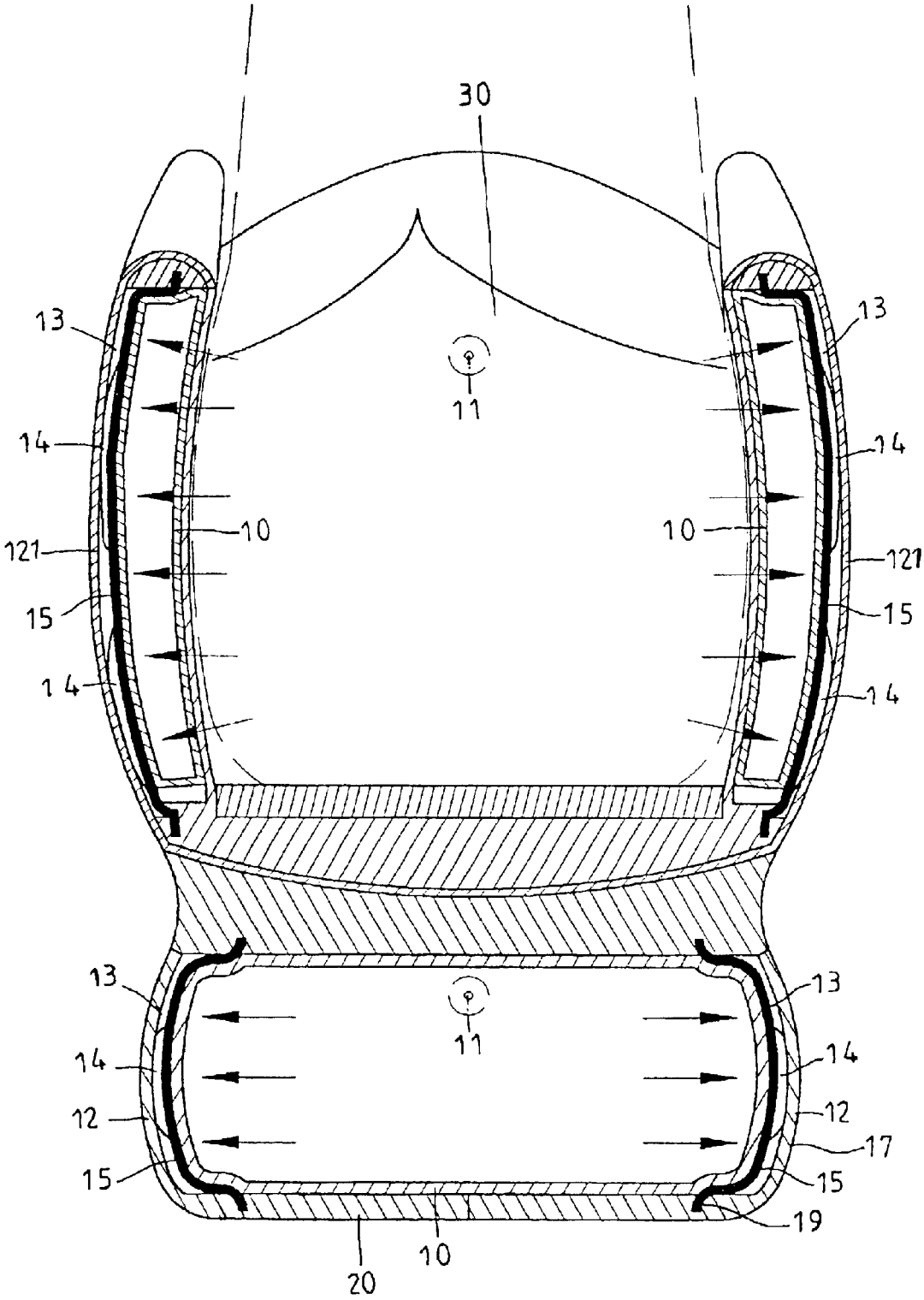
FIG. 6 is a cross sectional view similar to FIG. 5, illustrating the operation of the air bladder device.
Figure 7:
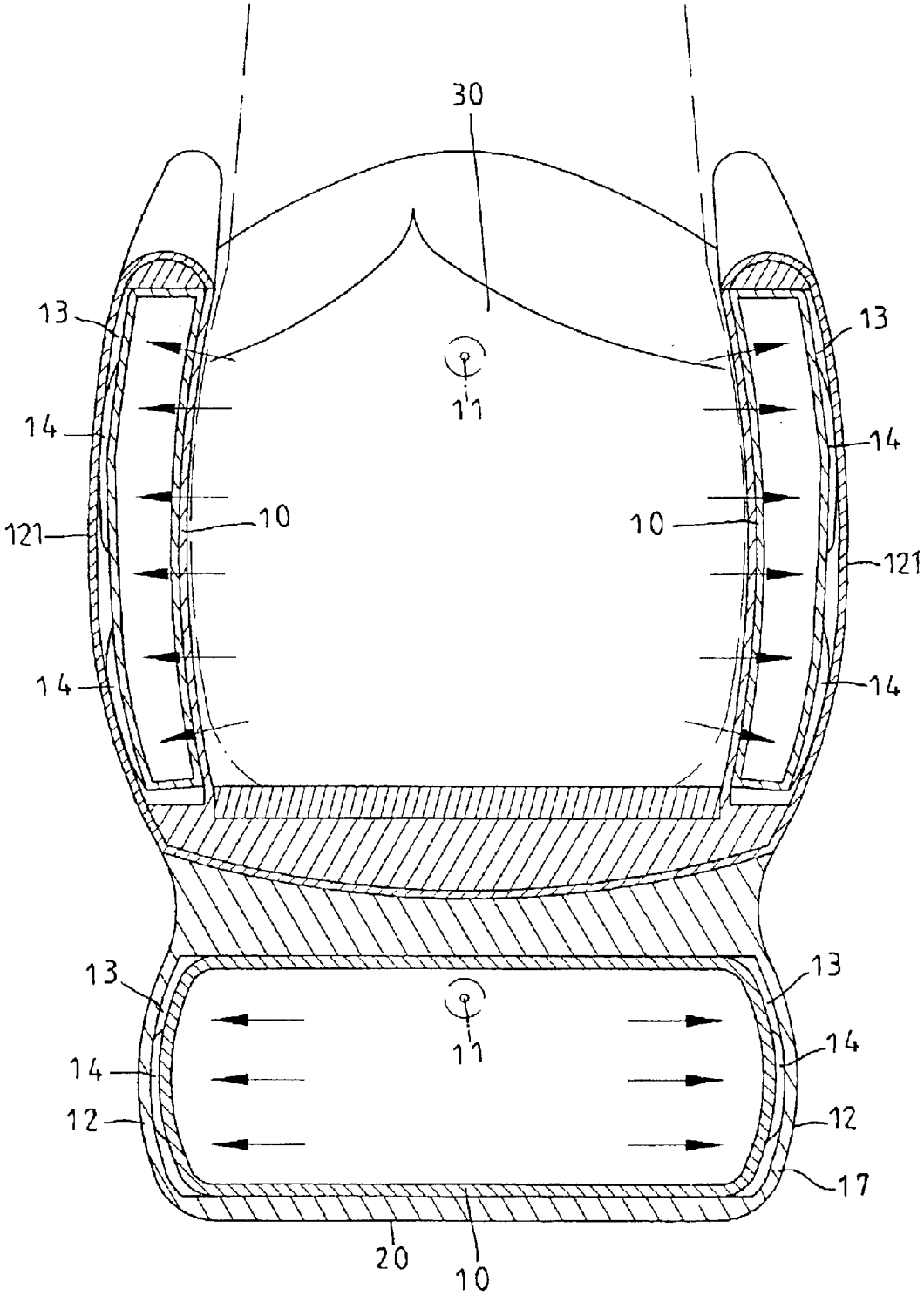
FIG. 7 is a cross sectional view similar to FIG. 6, illustrating the other arrangement of the air bladder device.
Figure 8:
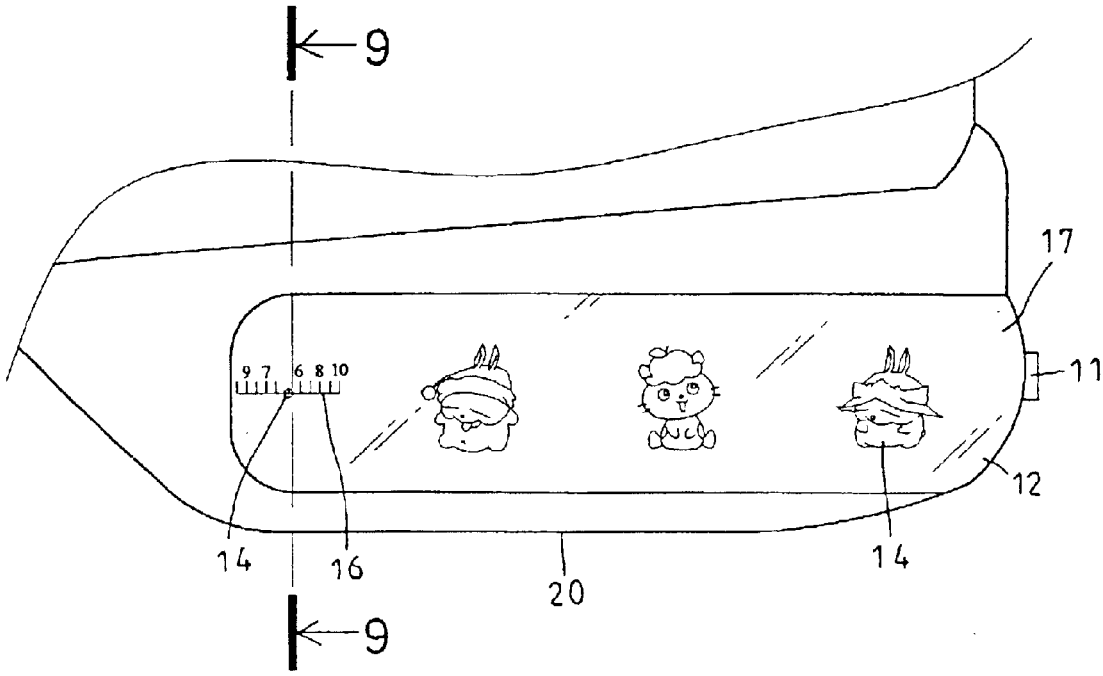
FIG. 8 is a partial side view showing the heel portion of the shoe.
Figure 9:
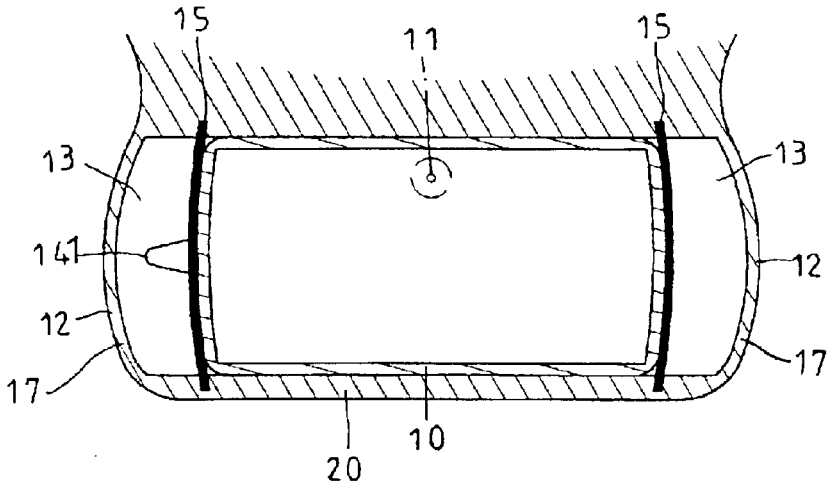
FIG. 9 is a cross sectional view taken along lines 9—9 of FIG. 8.
Figure 10:
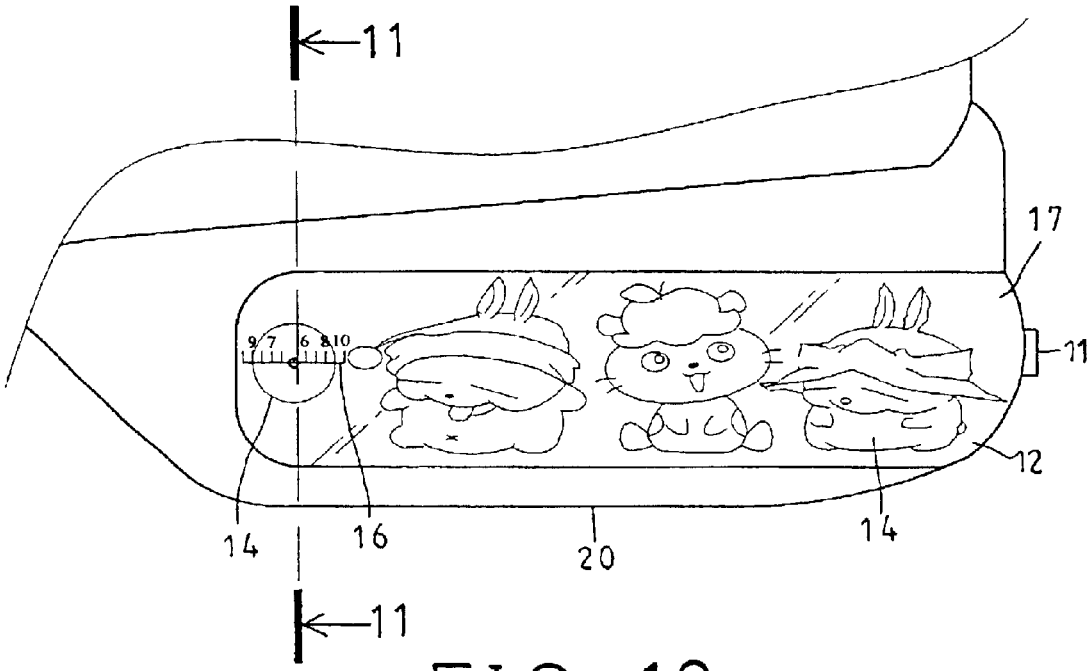
FIG. 10 is a partial side view similar to FIG. 8, showing the changing of the pattern of the air bladder device in the heel portion of the shoe.
Figure 11:
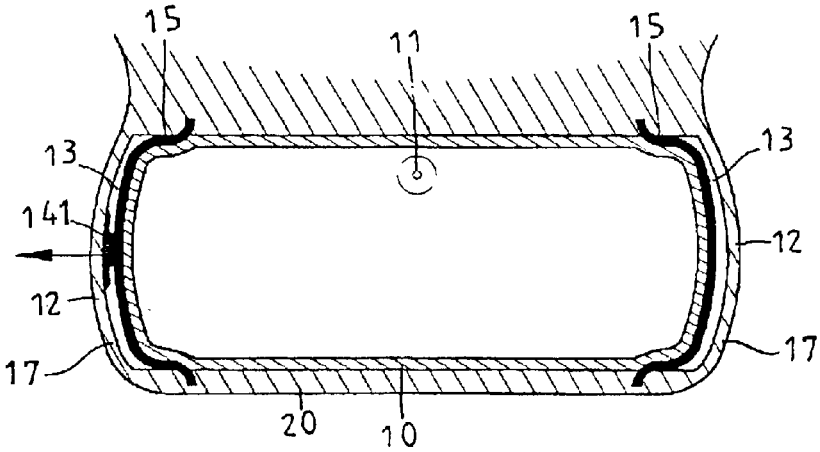
FIG. 11 is a cross sectional view taken along lines 11—11 of FIG. 10.
Figure 12:
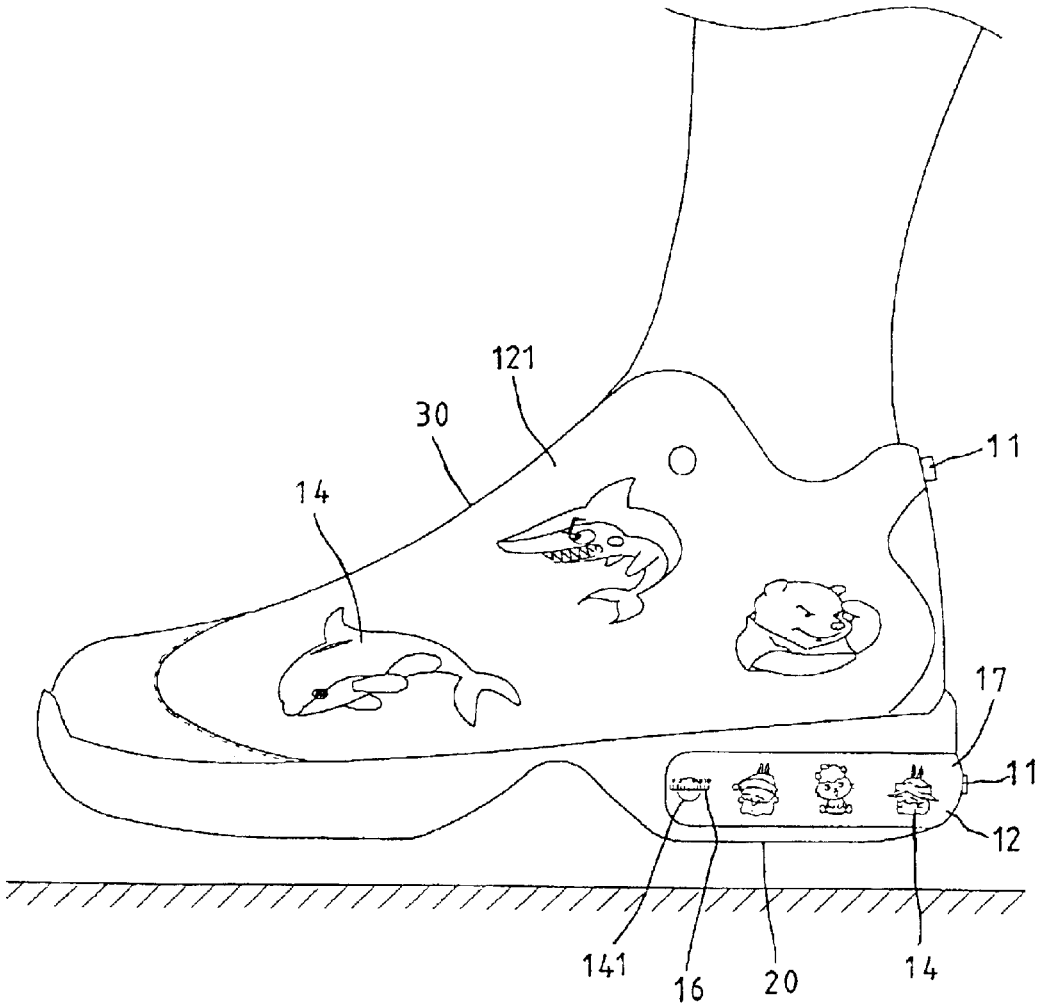
FIGS. 12, 13 are side views illustrating the operation of the air bladder device.
Figure 13:
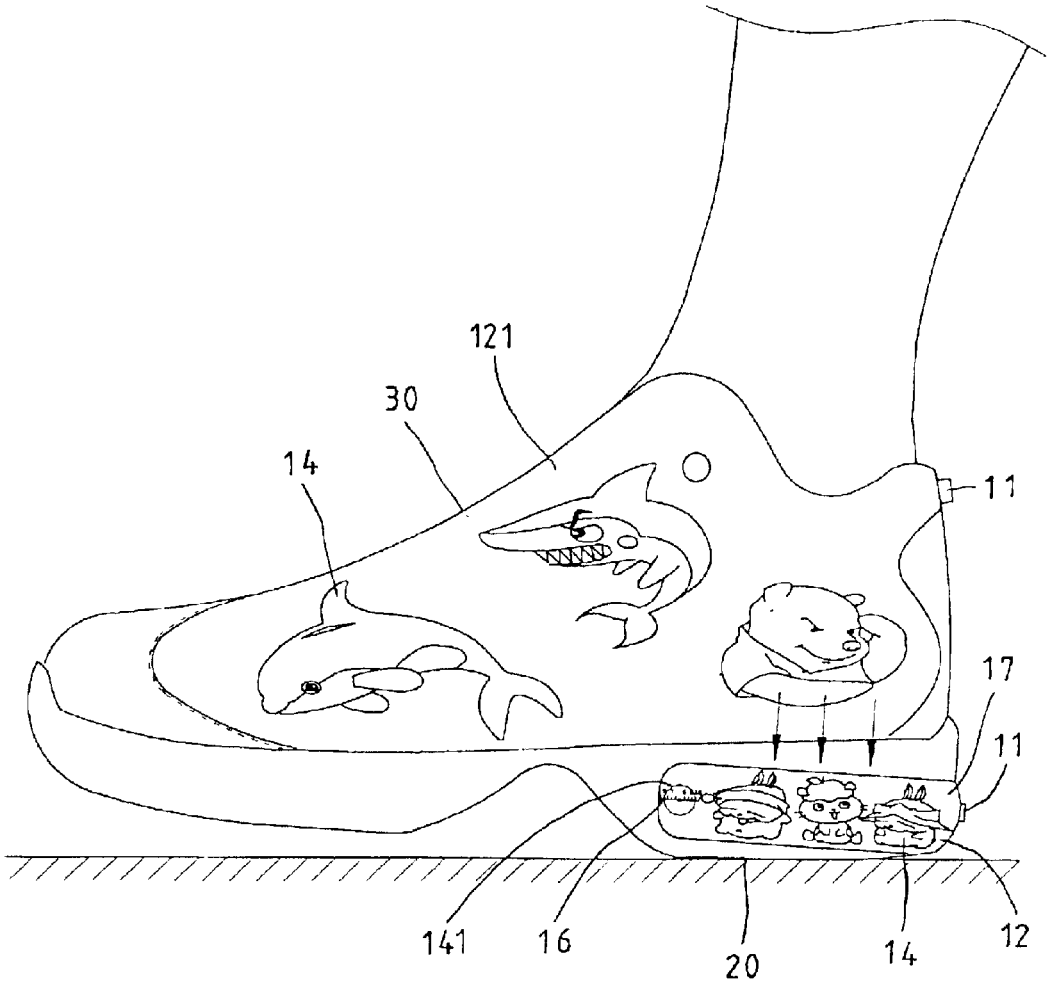

The strap 15 includes one or more patterns 14, 141, such as planar or spatial patterns 14, 141 provided on the outer peripheral portion thereof, and facing toward the wall 17 of the casing 12 for being forced to be engaged with the wall 17 of the casing 12 (FIGS. 6, 7, 11). The patterns 14, 141 are preferably made of rubber, soft, or resilient, or the other compressible or deformable materials.

The casing 12 may be received in a cavity 21 of a shoe sole 20 or a shoe 30, such as received in the heel portion of the shoe sole 20, and preferably having the outer peripheral wall 17 flush with or slightly and outwardly extended from the outer peripheral surface of the shoe sole 20, for allowing the air bag 10 to be depressed or compressed by the users.

The air bag 10 is received in the chamber 13 of the casing 12, and engaged in the strap 15, best shown in FIGS. 5, 6, 9, 11. In operation, the air may be filled into the air bag 10 via the nozzle 11, for inflating the air bag 10 to force the patterns 14 onto or against the wall 17 of the casing 12 (FIGS. 6, 7, 11).

Alternatively, the air bag 10 may be inflated to a condition that has not been fully inflated. For example, as shown in FIGS. 5, 8, 9 and 12, the air bag 10 may not force the patterns 14, 141 against the wall 17. However, the feet of the users may apply a force against the air bag 10 in order to inflate the air bag 10, and to cause the air bag 10 to force the patterns 14, 141 onto or against the wall 17 (FIGS. 6, 7, 11).

As best shown in FIGS. 6, 7, 10, 11 and 13, when the patterns 14, 141 are forced onto or against the wall 17, particularly the transparent or semi-transparent wall 17, the patterns 14 may be deformed or enlarged into various kinds of changing patterns or shapes.

The pattern 141, such as the rubber or resilient or soft stud 141, is preferably aligned with the scale 16 of the casing 12, and may be deformed to show the inflation of the air bag 10. For example, the scale 16 may be calibrated to show such as 40–100% inflation of the air bag 10, when the stud pattern 141 is forced or deformed against the wall 17, relative to the scale 16 of the casing 12, best shown in FIGS. 10–13.

Figure 14:
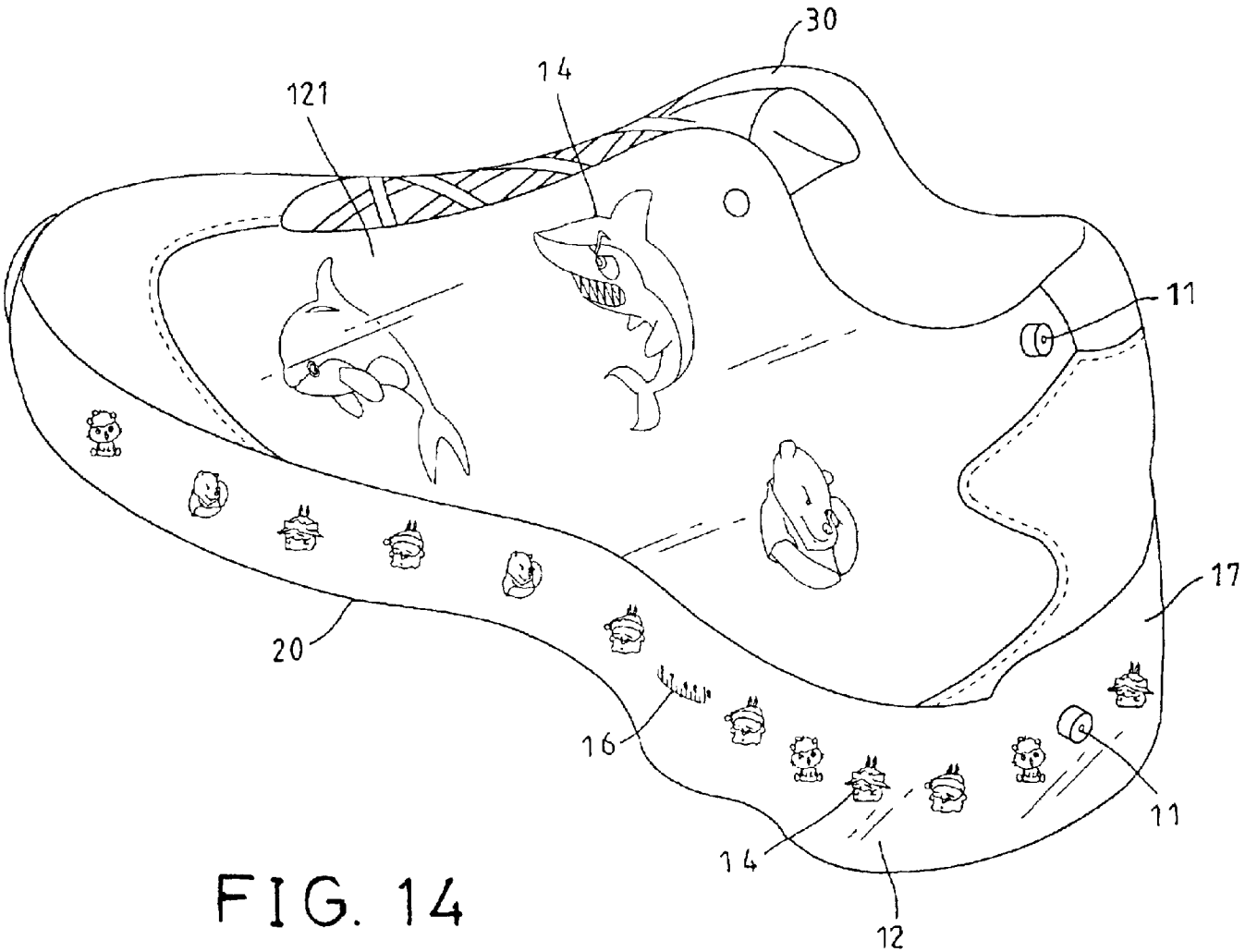
FIG. 14 is a perspective view illustrating the other arrangement of the air bladder device in the shoe.
Figure 15:
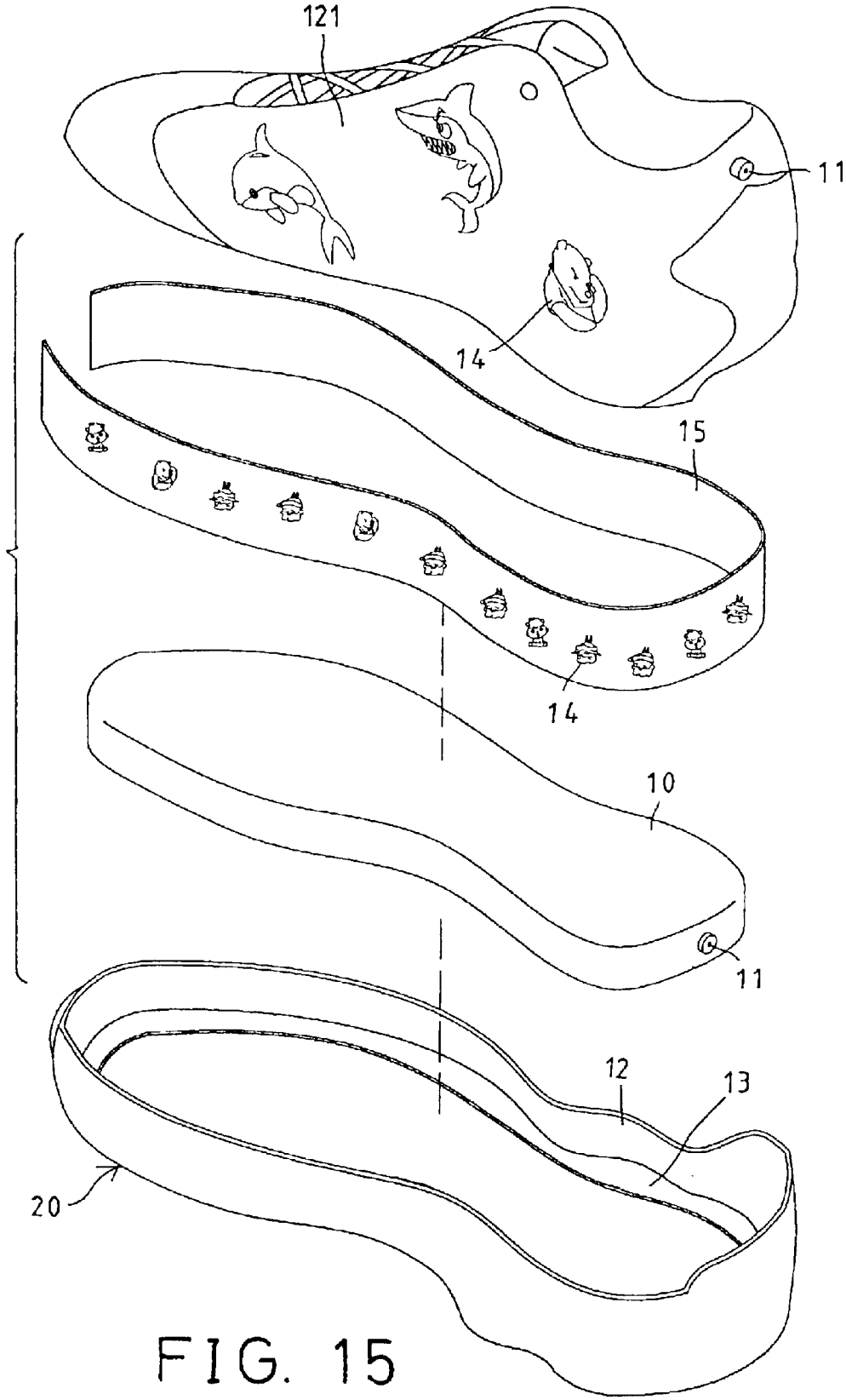
FIG. 15 is a partial exploded view of the shoe as shown in FIG. 14.

As shown in FIGS. 1, 2, 12–15, the casing 121 may also be formed into various shapes, for attaching onto the faces or the fronts of the shoe 30, and may also have a strap 15 or a number of patterns 14 provided between the casing 121 and the air bag 10. As shown in FIGS. 14, 15, the casing 12 may also be formed into a shape corresponding to that of the shoe sole 20 of the shoe 30, and for forming as the shoe sole 20.

Figure 16:
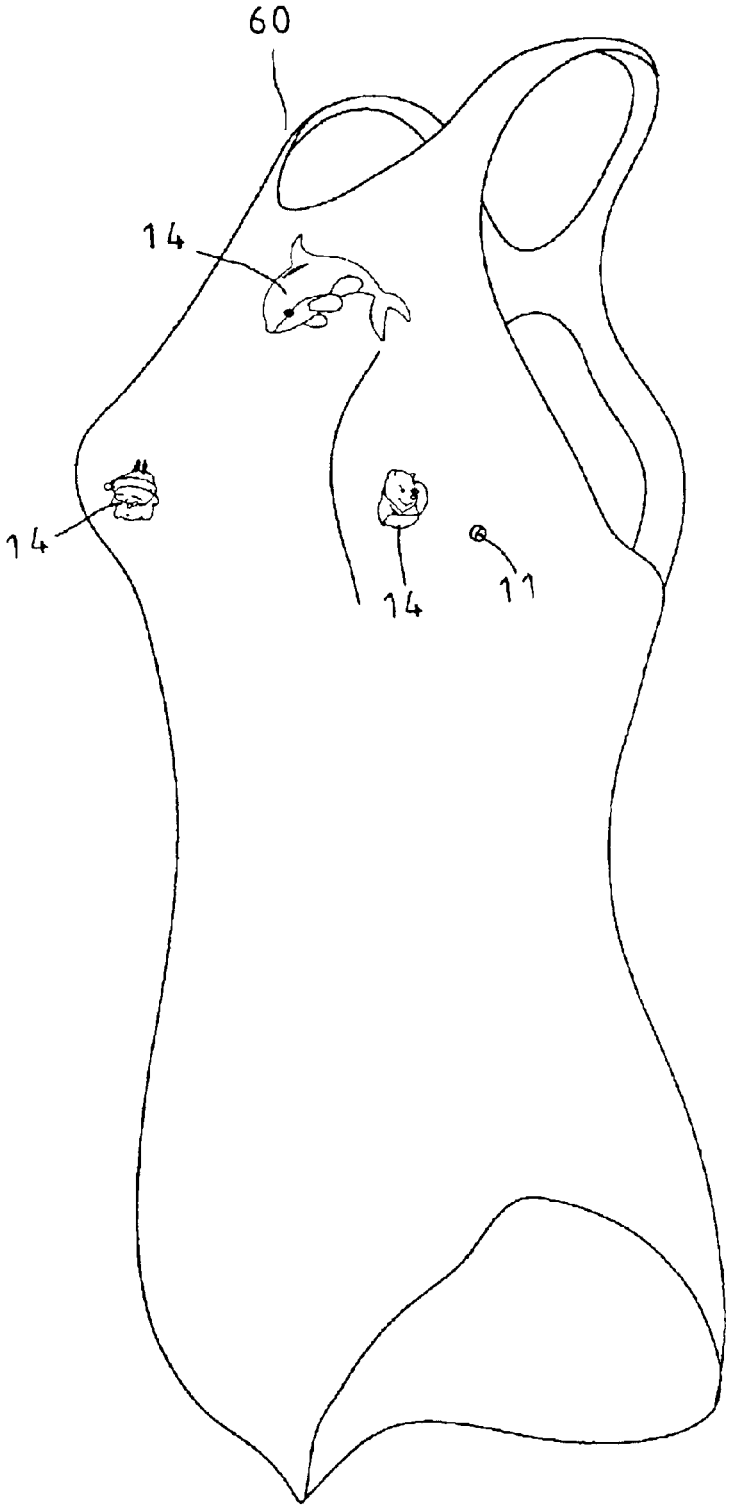
FIGS. 16, 17, 18 are perspective views illustrating the arrangements or the attachments of the air bladder device onto various objects.
Figure 17:
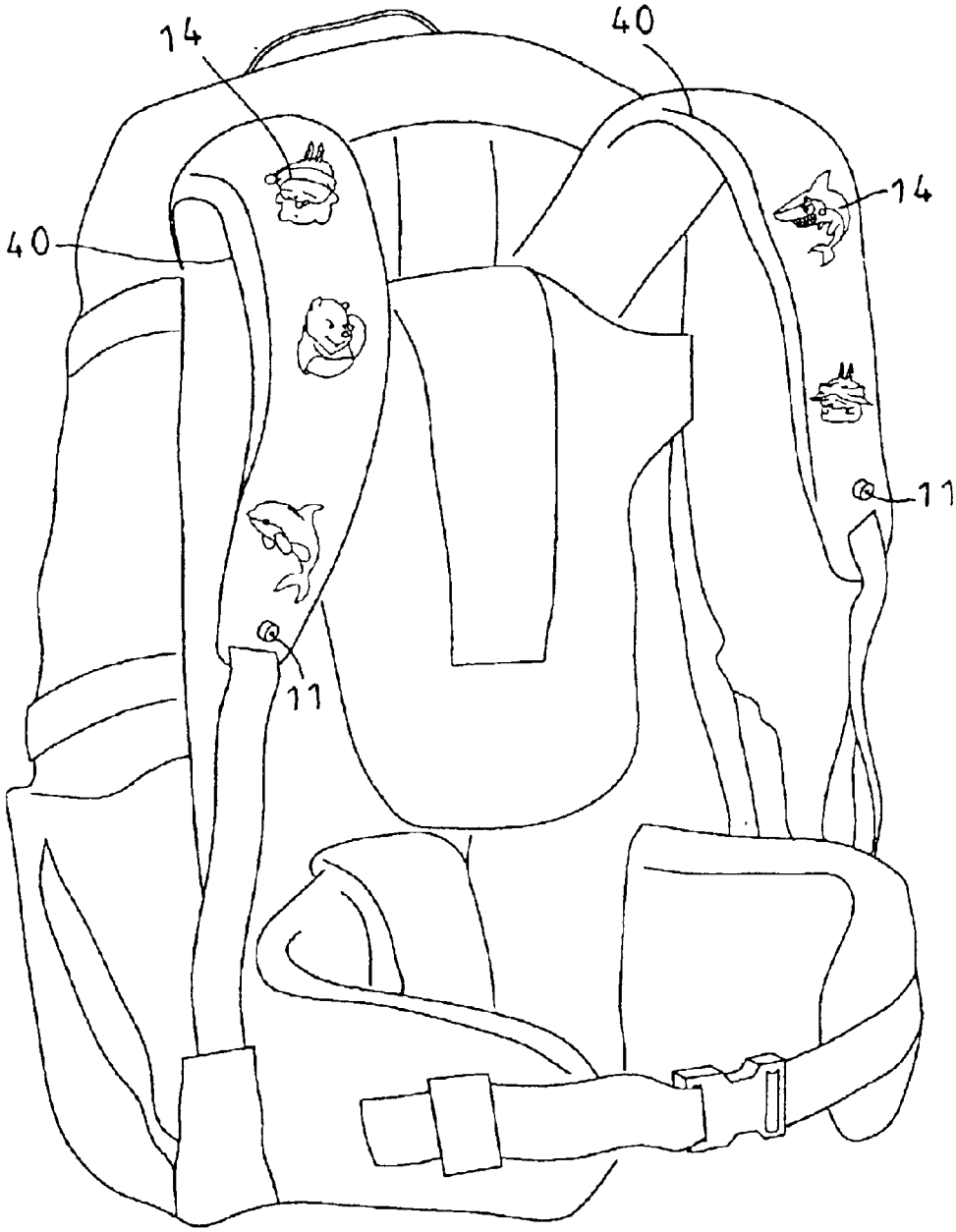
Figure 18:
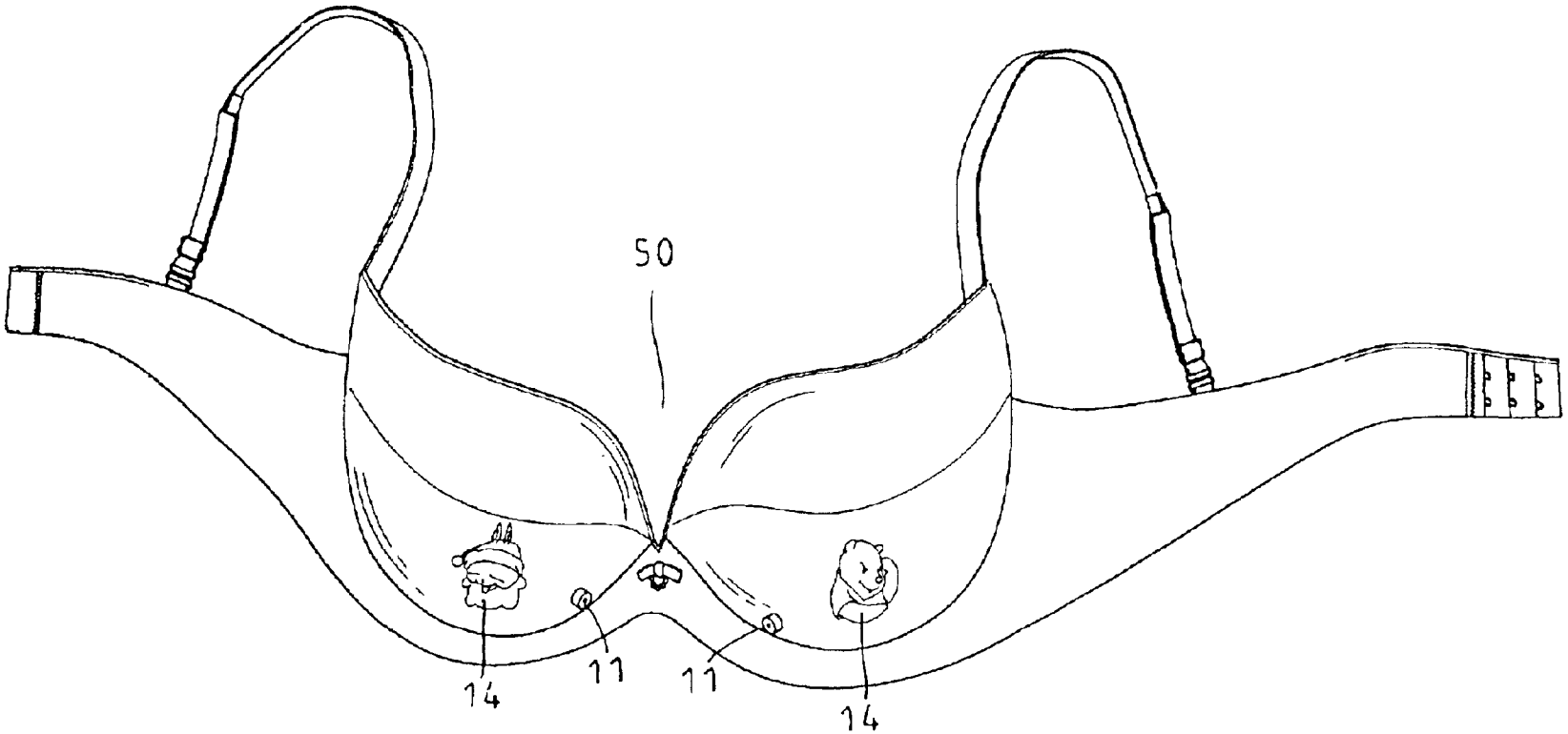

As shown in FIGS. 16–18, the air bladder device may also be attached onto the other objects, such as the swim suit 60 as shown in FIG. 16, the fastening belts 40 of the suitcase members or luggage members or the like as shown in FIG. 17, or the bra 50 as shown in FIG. 18.

Alternatively, as shown in FIG. 7, the patterns 14 may also be directly attached onto the air bag 10 or onto the peripheral wall 17, or be simply disposed between the air bag 10 and the wall 17, without the strap 15. The patterns 14, 141 that are disposed or received between the air bag 10 and the wall 17 may be arranged to be forced against the wall 17, and may be deformed to various or changing patterns, or to show the inflation of the air bag 10.

Further alternatively, when the patterns 14, 141 include a planar structure, and when the patterns 14, 141 are forced to move toward the wall 17, the patterns 14, 141 may also be seen through the wall 17 as changing patterns due to different transparency of the wall 17. The typical air bladder devices fail to suggest to provide a pattern 14, 141 movable toward or away from the transparent or semi-transparent wall 17.

Accordingly, the air bladder device in accordance with the present invention includes a pattern changeable mechanism, for allowing the patterns to be deformed to various changing patterns, or for showing the inflation condition of the air bladder.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An air bladder device comprising:

a casing including a wall, and a chamber formed and defined in said wall, an air bag received in said chamber of said casing, at least one pattern disposed between said wall of said casing and said air bag, said air bag being inflatable to move said at least one pattern toward and away from said wall, for allowing said at least one pattern to be seen through said wall as a changing pattern, and a strap disposed between said wall of said casing and said air bag, said at least one pattern being attached on said strap.

2. The air bladder device according to claim 1, wherein said air bag includes a nozzle for filling air into and out of said air bag.

3. The air bladder device according to claim 2, wherein said casing includes an orifice formed therein for receiving said nozzle of said air bag.

4. The air bladder device according to claim 1, wherein said at least one pattern is a spatial pattern.

5. The air bladder device according to claim 1, wherein said casing includes a panel having a groove formed therein, said strap includes a bottom peripheral portion received in said groove of said panel of said casing.

6. The air bladder device according to claim 1 further comprising an object including a cavity formed therein, said casing being received and secured in said cavity of said object.

7. An air bladder device comprising:

a casing including a wall, and a chamber formed and defined in said wall, and including a scale provided on said wall, an air bag received in said chamber of said casing, and at least one pattern disposed between said wall of said casing and said air bag, said at least one pattern being a spatial pattern, said air bag being inflatable to move said at least one pattern toward and away from said wall, for allowing said at least one pattern to be seen through said wall as a changing pattern, and said at least one pattern being aligned with said scale and movable toward and away from said scale, and being deformable to indicate inflation of said air bag together with said scale.

8. An air bladder device comprising:

a casing including a wall, and a chamber formed and defined in said wall, and including a scale provided on said wall, an air bag received in said chamber of said casing, and at least one pattern disposed between said wall of said casing and said air bag, and aligned with said scale and movable toward and away from said scale, said air bag being inflatable to move said at least one pattern toward and away from said wall, for allowing said at least one pattern to be seen through said wall as a changing pattern.

9. An air bladder device comprising:

a casing including a wall, and a chamber formed and defined in said wall, an air bag received in said chamber of said casing, at least one pattern disposed between said wall of said casing and said air bag, said air bag being inflatable to move said at least one pattern toward and away from said wall, for allowing said at least one pattern to be seen through said wall as a changing pattern, and an object including a cavity formed therein, said casing being received and secured in said cavity of said object, said object being a shoe having a shoe sole, said shoe sole including said cavity formed therein for receiving said casing, and for allowing said casing to be depressed by users.

10. An air bladder device comprising:

a casing including a transparent wall, and a chamber formed and defined in said wall, and including a scale provided on said wall, an air bag received in said chamber of said casing, and at least one spatial pattern disposed between said wall of said casing and said air bag, said air bag being inflatable to force said at least one spatial pattern toward and against said wall, and said at least one spatial pattern being deformable for allowing said at least one spatial pattern to be deformed when forced against said wall, and to be seen through said wall as a changing pattern, and said at least one spatial pattern being aligned with said scale and movable toward and against said scale, to indicate inflation of said air bag together with said scale.

11. An air bladder device comprising:

a casing including a transparent wall, and a chamber formed and defined in said wall, an air bag received in said chamber of said casino, at least one spatial pattern disposed between said wall of said casing and said air bag, said air bag being inflatable to force said at least one spatial pattern toward and against said wall, and said at least one spatial pattern being deformable for allowing said at least one spatial pattern to be deformed when forced against said wall, and to be seen through said wall as a changing pattern, and a strap disposed between said wall of said casing and said air bag, said at least one pattern being attached on said strap.

12. The air bladder device according to claim 11, wherein said casing includes a panel having a groove formed therein, said strap includes a bottom peripheral portion received in said groove of said panel of said casing.

* * * * *